US006318257B1

(12) United States Patent
Niemiro et al.

(10) Patent No.: US 6,318,257 B1
(45) Date of Patent: Nov. 20, 2001

(54) BEARING SUPPORT SYSTEM FOR A PRINTING PRESS HAVING CANTILEVERED CYLINDERS

(75) Inventors: Thaddius A. Niemiro, Lisle; Thomas W. Orzechowski, Orland Park; Radoslaw Kulesza, Westmont, all of IL (US)

(73) Assignee: Goss Graphic Systems, Inc., Westmont, IL (US)

( * ) Notice: Subject to any disclaimer, the term of this patent is extended or adjusted under 35 U.S.C. 154(b) by 0 days.

(21) Appl. No.: 09/312,137

(22) Filed: May 14, 1999

Related U.S. Application Data

(63) Continuation-in-part of application No. 08/920,462, filed on Aug. 29, 1997, now Pat. No. 5,943,955.

(51) Int. Cl.[7] ..... B41F 13/00

(52) U.S. Cl. ..... 101/212; 216/247

(58) Field of Search ..... 61/212, 216, 217, 61/152, 153, 247, 248, 375, 376, 378, 382.1, 383, 389.1, 218, 219, 477

(56) References Cited

U.S. PATENT DOCUMENTS

| | | | | |
|---|---|---|---|---|
| Re. 33,944 | | 6/1992 | Knauer . | |
| Re. 34,970 | | 6/1995 | Tittgemeyer . | |
| 1,134,697 | | 4/1915 | Pervilhac . | |
| 3,003,417 | | 10/1961 | Englander . | |
| 3,129,662 | | 4/1964 | Pinkerton . | |
| 3,789,757 | | 2/1974 | Motter et al. . | |
| 4,111,120 | | 9/1978 | Paulson . | |
| 4,350,555 | * | 9/1982 | Popoff | 101/33 |
| 4,372,205 | * | 2/1983 | Pflaum | 101/153 |
| 4,477,954 | | 10/1984 | Molinatto . | |
| 4,487,124 | * | 12/1984 | Köbler | 101/216 |
| 4,697,516 | | 10/1987 | Rombout . | |
| 4,802,411 | * | 2/1989 | Witczak | 101/216 |
| 4,807,527 | | 2/1989 | Knauer . | |
| 4,876,958 | | 10/1989 | Townsend . | |
| 4,901,641 | | 2/1990 | Steiner et al. . | |
| 4,913,048 | | 4/1990 | Tittgemeyer . | |
| 4,932,322 | | 6/1990 | Keller . | |
| 4,934,264 | | 6/1990 | Gansky et al. . | |
| 4,953,462 | * | 9/1990 | Kruber | 101/216 |
| 4,967,658 | | 11/1990 | Townsend . | |
| 4,991,503 | | 2/1991 | Morner . | |

(List continued on next page.)

FOREIGN PATENT DOCUMENTS

| | | |
|---|---|---|
| 607 760 | 10/1978 | (CH) . |
| 470947 | 2/1929 | (DE) . |
| 195 15 459 A1 | 10/1996 | (DE) . |
| 0 406 694 A2 | 1/1991 | (EP) . |
| 0 782 919 A1 | 7/1997 | (EP) . |

OTHER PUBLICATIONS

PCT International Search Report dated Dec. 11, 1998, Appl. No. PCT/US98/17785, filed Aug. 27, 1998.

*Primary Examiner*—Eugene Eickholt
(74) *Attorney, Agent, or Firm*—Marshall, Gerstein, & Borun

(57) ABSTRACT

A bearing assembly for rotatably supporting the cylinder on a printing press is disclosed. The printing press comprises a frame, a support shaft, a cylinder, and the bearing assembly. The support shaft includes an inner fixed end attached to the frame, a free end disposed outwardly away from the frame, and an interconnecting central portion. The bearing assembly rotatably supports the cylinder on the support shaft The bearing assembly includes an inboard bearing set secured to the support shaft adjacent the central portion, and further includes an outboard bearing set secured to the support shaft adjacent the free end. A portion of the bearing assembly is adapted to permit angular adjustment of the cylinder about an axis perpendicular to the support shaft longitudinal axis.

36 Claims, 8 Drawing Sheets

U.S. PATENT DOCUMENTS

| | | | | |
|---|---|---|---|---|
| 5,092,240 | | 3/1992 | Schumacher . | |
| 5,101,726 | | 4/1992 | Lübke et al. . | |
| 5,140,899 | * | 8/1992 | Greer et al. | 101/348 |
| 5,188,027 | | 2/1993 | Fantoni . | |
| 5,237,920 | | 8/1993 | Guaraldi . | |
| 5,241,905 | | 9/1993 | Guaraldi et al. . | |
| 5,392,709 | | 2/1995 | Seyffert et al. . | |
| 5,394,797 | | 3/1995 | Döbler et al. . | |
| 5,458,061 | | 10/1995 | Koura et al. . | |
| 5,461,978 | * | 10/1995 | Chou | 101/216 |
| 5,481,972 | | 1/1996 | Schmid . | |
| 5,505,127 | | 4/1996 | Knauer . | |
| 5,540,153 | * | 7/1996 | Campbell et al. | 101/493 |
| 5,647,275 | * | 7/1997 | Lupa et al. | 101/216 |
| 5,711,222 | | 1/1998 | Taylor et al. . | |
| 5,787,808 | | 8/1998 | Stram et al. . | |
| 5,943,955 | * | 8/1999 | Niemiro et al. | 101/216 |

* cited by examiner $$\Delta_1 = \frac{wL_2^4}{8EI_1}$$

$$\Delta_2 = \frac{1}{EI_1}\left(\frac{WL_1^4}{8} - \frac{RL_1^3}{3}\right)$$

$$\Delta_3 = \frac{RL^3}{3EI_2}$$

FOR EVEN STRIPE $\Delta_1 = \Delta_2$

BUT $\Delta_2 = \Delta_3 \therefore \Delta_1 = \Delta_2 = \Delta_3$

SOLVING FOR $L_1$ AND $L_2$ $$\frac{L_1}{L_2} = \sqrt[4]{\frac{I_1 + I_2}{I_1}}$$

BEARING SUPPORT SYSTEM FOR A PRINTING PRESS HAVING CANTILEVERED CYLINDERS

RELATED APPLICATIONS

This application is a Continuation-in-Part of application Ser. No. 08/920,462, filed Aug. 29, 1997 now U.S. Pat. No. 5,943,955.

FIELD OF THE INVENTION

The present invention relates generally to a rotary offset printing press having removable impression and blanket sleeves mounted on axially rotatable plate and blanket cylinders, respectively. More specifically, the present invention relates to an improved bearing assembly for rotatably supporting such cylinders.

BACKGROUND OF THE INVENTION

Rotary offset printing presses having rotatable cylinders and removable impression and blanket sleeves are generally well known in the art. Such presses typically operate at very high speeds and are capable of printing a high quantity of material in a relatively short period of time. A continuous web of paper passes between a pair of rotating blanket cylinders which print images on opposites sides of the paper web. Each blanket cylinder is in contact with a plate cylinder having an impression sleeve which has been inked and dampened and which transfers the images to the blanket cylinder for printing onto the web in a manner well known in the art.

In order to change the printed material, such as when a newspaper, magazine or brochure is switched to a different edition, the plate cylinder is moved away from its adjacent blanket cylinder, the impression sleeve on the plate cylinder is removed, and a different impression sleeve is installed. When the changeover process is complete the press is ready for the next printing run.

Many times, such changeovers occur with great frequency, such as when small jobs are being printed. Unfortunately, the process of changing the impression sleeve is very labor intensive and time consuming, and thus there is considerable down time for the press. Typically, each cylinder in the press is mounted for axial rotation between a pair of spaced apart side walls. The impression sleeves are mounted to the cylinders, and fit so snugly that the sleeves are held in place by friction. In order to move the sleeve relative to the cylinder, compressed air is forced between the inner surface of the sleeve and the outer surface of the supporting cylinder. The cushion of air expands the sleeve slightly, and allows the sleeve to slide relative to the cylinder. Thus, in order to install or remove the impression sleeve from the plate cylinder, the plate cylinder must first be disconnected and removed from the side walls. Thereafter, a new impression sleeve is placed on the cylinder in the same manner and the rotatable cylinder is reinstalled in preparation for the next printing run. As outlined above, this is a very time consuming process and seriously undermines the cost effectiveness of the press when the press is being used on relatively small jobs.

A number of approaches have been attempted in order to decrease the changeover time between printing runs. For example, one approach as disclosed in U.S. Pat. No. 4,807,527 is to provide a releasable bearing on one end of the cylinder shaft. Removal of the bearing assembly creates an access hole in the press side wall and exposes one end of the cylinder shaft so that the impression sleeve can slide off the shaft through the access hole. The other end of the shaft is elongated, and during the changeover process the elongated portion of the shaft abuts an auxiliary shaft which is put in place for temporary support.

Similarly, U.S. Pat. No. Re. 34,970 discloses a pivotable bearing which swings away to free up one end of the cylinder for the removal of the sleeve, and also discloses a cylinder supported by a pair of linearly retractable bearings, and finally a cylinder mounted to a swivel on one end and having a retractable bearing on the other.

Unfortunately, in addition to other shortcomings, each of the prior art devices requires some means of temporary cylinder support in order to effectuate the changeover of the impression sleeve. In addition, each of the prior art devices requires that at least one of the bearing assemblies be completely disconnected from the cylinder shaft, and thus, neither of these approaches provides a cost effective solution to the problems outlined above.

Another problem with prior art printing presses is that all of the rotating cylinders in the machine are mechanically connected to a single drive shaft system, which creates a number of inherent drawbacks For example, all of the rotating cylinders and rollers in a printing press are typically connected to a common drive system, which consist of an extensive collection of drive shafts, gearboxes and pulleys, all of which is designed to spin all of the cylinders in the press at the same peripheral speed. Because all of the cylinders must have access to the same drive system, the placement of the cylinders relative to each other is severely constrained, which adds to the difficulty in changing impression sleeves on the plate cylinders. Moreover, on large presses there is noticeable lash in the drive system, which causes registration and vibration problems, both of which negatively impact print quality.

Still another problem is the difficulty m maintaining acceptable print quality when longer cylinders are used. For example, because the outer end of a cantilevered cylinder may deflect, it is difficult to maintain even printing pressure along the length of the cylinder. Such a problem is of course exacerbated when longer print cylinders are used. Uneven cylinder pressure causes web wrinkling and web migration.

Accordingly, there exists a need for a rotary offset printing press having cantilevered cylinders which permit fast replacement of the impression sleeve and which do not require temporary support during changeover. There also exists a need for self-driven cylinders which reduce or eliminate drive line lash and which also improve registration and overall system performance. Such cylinders will preferably be supported in such a manner that print quality is maintained even when relatively long cylinders are employed.

There also exists a need for a system for supporting relatively long cylinders, especially cantilevered cylinders, in such a manner that the pressure between the cylinders along their length can be made substantially uniform.

SUMMARY OF THE INVENTION

According to one aspect of the invention, a printing press comprises a frame, a support shaft, a cylinder, and a bearing assembly. The support shaft includes an inner fixed end attached to the frame, a free end disposed outwardly away from the frame, and an interconnecting central portion. The bearing assembly rotatably supports the cylinder on the support shaft. The bearing assembly includes an inboard bearing set secured to the support shaft adjacent the central portion, and further includes an outboard bearing set secured to the support shaft adjacent the free end. A portion of the bearing assembly is adapted to permit angular adjustment of the cylinder about an axis perpendicular to the support shaft longitudinal axis.

In further accordance with a preferred embodiment, the support shaft includes an inboard portion disposed adjacent the frame and having a first cross-section, and further includes an outboard portion having a second cross-section less than the first cross-section, such that the inboard portion is stiffer than the outboard portion.

Preferably, the inboard bearing set includes an inner race mounted to the shaft, a ring assembly mounted to the inner race, and an outer bearing set surrounding the ring assembly. The outer bearing set includes an inner race secured to the ring assembly and a moveable race secured to the cylinder. The inner race, which may be constructed of bronze, includes a convex outer surface, and the ring assembly includes a concave inner surface sized to be received over the inner race convex outer surface. The ring assembly may include an inboard ring and an outboard ring, with the inboard ring and the outboard ring being secured to each other and surrounding the inner race. The ring assembly and the inner race engage at a generally spherical interface, such that the ring assembly is adapted to swivel about a center point of the inner race.

An inboard retaining member may be operatively connected to the inboard ring, with the retaining member and the outboard ring including opposed, cooperating shoulder portions adapted to secure an inner race of the outer bearing set to the ring assembly. Further, the bearing assembly may be adapted for longitudinal movement relative to the support shaft, such as by employing a pin in slot connection between the retaining member and the support shaft. The inboard retaining member will preferably secure the ring assembly against rotation about the support shaft.

The support shaft may include an inner portion having a first cross-section and an outer portion having a second cross-section less than the first cross-section. Preferably, the bearing assembly is disposed along the support shaft a predetermined distance from the support shaft fixed end, and will still preferably be disposed on the support shaft outer portion.

The cylinder may include an inboard end and an outboard end and the support shaft may include an axial bore, with a drive shaft being provided which extends though the axial bore and has an inboard end adapted to engage a drive motor and an outboard end adapted to engage the cylinder outboard end. The bearing assembly and the drive shaft may be adapted for axial movement relative to the support shaft.

The bearing assembly and the support shaft may be adapted to permit the cylinder to swivel about a predetermined location, and the outboard bearing set preferably includes an eccentric mechanism adapted to adjust the angular position of the cylinder The cylinder will preferably enclose an internal cavity with the cylinder cavity being adapted to house therein a quantity of lubricant. The a barrier ring may be provided which is operatively connected to an inner surface of the cylinder, with the barrier ring having a peripheral groove adapted to receive an O-ring. The barrier ring may be positioned such that O-ring is disposed against the cylinder inner surface.

According to another aspect of the invention, a printing press comprises a frame, a support shaft, a cylinder sized for placement over the support shaft, and a bearing assembly. The support shaft includes an inboard portion having a fixed end attached to the frame, an outboard portion having a free end disposed outwardly away from the frame, and an interconnecting portion, with inboard portion having a first cross section and the outboard portion having a second cross section less than the first cross section. The bearing assembly rotatably supports the cylinder on the support shaft and includes an inboard bearing set secured to the support shaft outboard portion and includes an outboard bearing set. The inboard bearing set defines a center point disposed along a centerline of the support shaft a predetermined distance from the fixed end, and the outboard bearing set secures to the support shaft adjacent the support shaft free end. The bearing assembly is adapted to permit pivotal movement of the cylinder about the center point.

According to still another aspect of the invention, a bearing assembly for mounting a cantilevered printing cylinder to the frame of a printing press comprises a support shaft, with the support shaft having an inboard portion having a fixed end attached to the frame and an outboard portion having a free end disposed outwardly away from the frame. The inner portion has a first predetermined stiffness and the outer portion has a second predetermined stiffness. A printing cylinder is provided which is adapted to receive thereon an axially removable impression sleeve. A bearing assembly rotatably supports the printing cylinder on the support shaft, with the bearing assembly including an inboard bearing set and an outboard bearing set. The inboard bearing set is secured to the support shaft outboard portion and defines a swivel point disposed along a centerline of the support shaft a predetermined distance from the fixed end. The outboard bearing set is secured to the support shaft adjacent the free end. Accordingly, the bearing assembly permits swiveling adjustment of the printing cylinder about the swivel point.

According to a still further aspect of the invention, a printing press comprises a frame, a support shaft mounted to the frame and having a pair of ends and defining a longitudinal axis A cylinder is provided, as is a bearing assembly for rotatably supporting the cylinder on the support shaft. The bearing assembly is adapted to permit angular adjustment of the cylinder about an axis perpendicular to the support shaft longitudinal axis.

These and other objects of the invention will become readily apparent to those skilled in the art upon a reading of the following description with reference to the accompanying drawings.

DETAILED DESCRIPTION OF THE PREFERRED EMBODIMENT

The embodiments described herein are not intended to be exhaustive or to limit the invention to the precise form disclosed. They have been chosen and described in order to best explain the principles of the invention and its practical use in order to enable others skilled in the art to follow its teachings.

Figure 1:
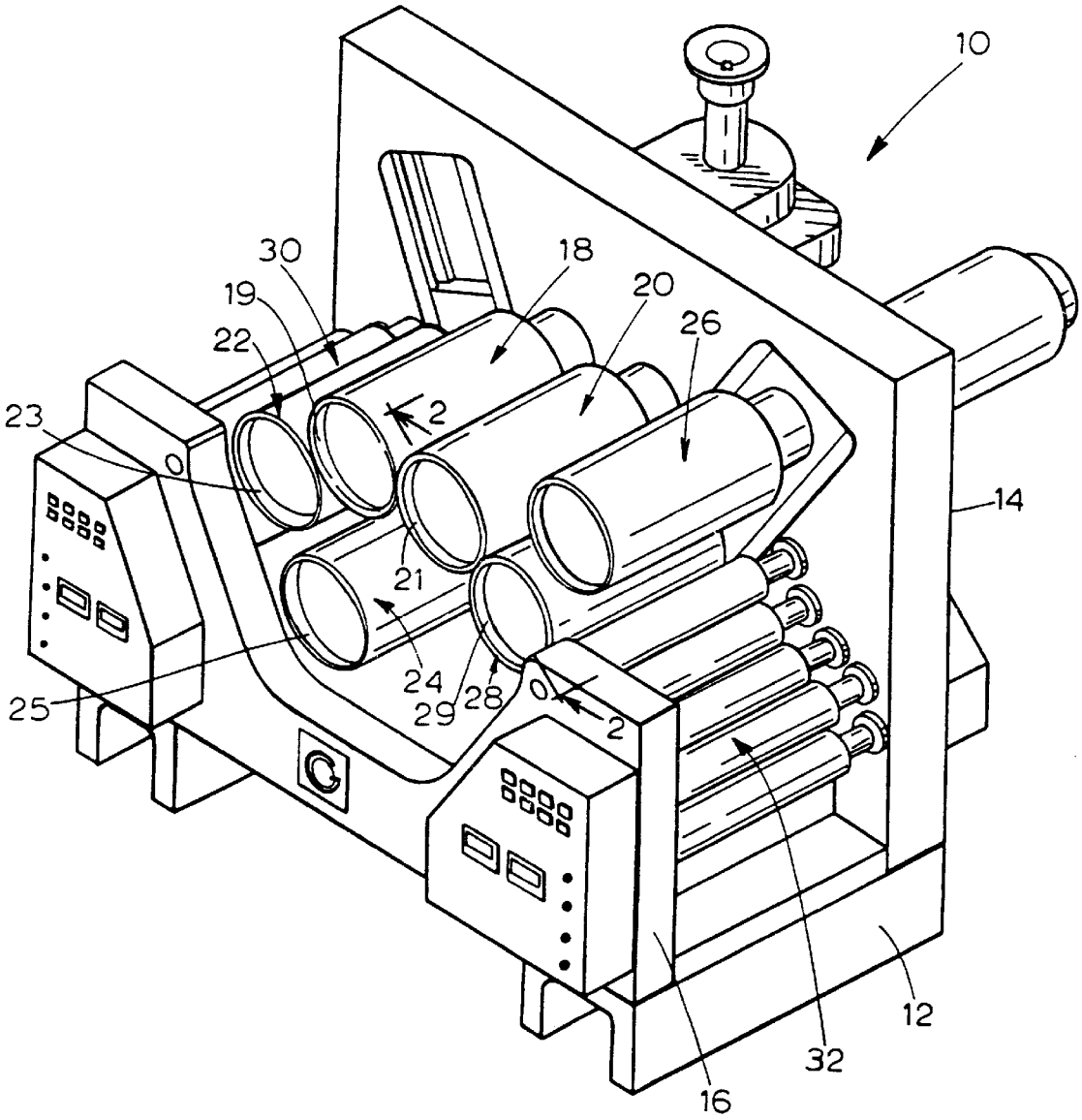
FIG. 1 is a perspective view of a rotary offset printing press incorporating the cantilevered, self-driven cylinders of the present invention shown in combination with several more conventional cylinders.

Referring now to the drawings, FIG. 1 illustrates a rotary offset printing press incorporating the features of the present invention and which is generally referred to by the reference numeral 10. Press 10 includes a frame 12 and a pair of opposing side walls 14, 16. Press 10 also includes a pair of blanket cylinder assemblies 18, 20 between which passes a web of paper (not shown) to be printed Each of the blanket cylinder assemblies 18, 20 is disposed adjacent a pair of plate cylinder assemblies 22, 24 and 26, 28, respectively. Blanket cylinder assemblies 18, 20 each support a generally hollow rotatable blanket cylinder 19, 21, respectively, and plate cylinder assemblies 22, 24, and 26, 28 each support a generally hollow rotatable plate cylinder 23, 25, and 27, 29, respectively, in a manner which will be explained in greater detail below. Preferably, plate cylinder assemblies 22, 24 are interchangeable, i.e., one or the other can be used for printing at any given time, as are plate cylinder assemblies 26, 28. Consequently, blanket cylinder assemblies 18, 20 are in contact with only one of their adjacent plate cylinder assemblies 22, 24 or 26, 28 during operation of the press 10. Each of blanket cylinder assemblies 18, 20 and plate cylinder assemblies 22, 24 and 26, 28 are mounted in cantilever fashion to side wall 14 in a manner which will be discussed in greater detail below.

Press 10 also includes a pair of ink roller assemblies 30, 32, each of which includes a plurality of individual inking rollers. Ink roller assemblies 30, 32 apply ink and/or a dampening solution to their adjacent plate cylinders 22, 24 and 26, 28 respectively, in a manner well known in the art. Ink roller assemblies 30, 32 are rotatably mounted between side walls 14, 16 in a conventional manner.

Figure 2:
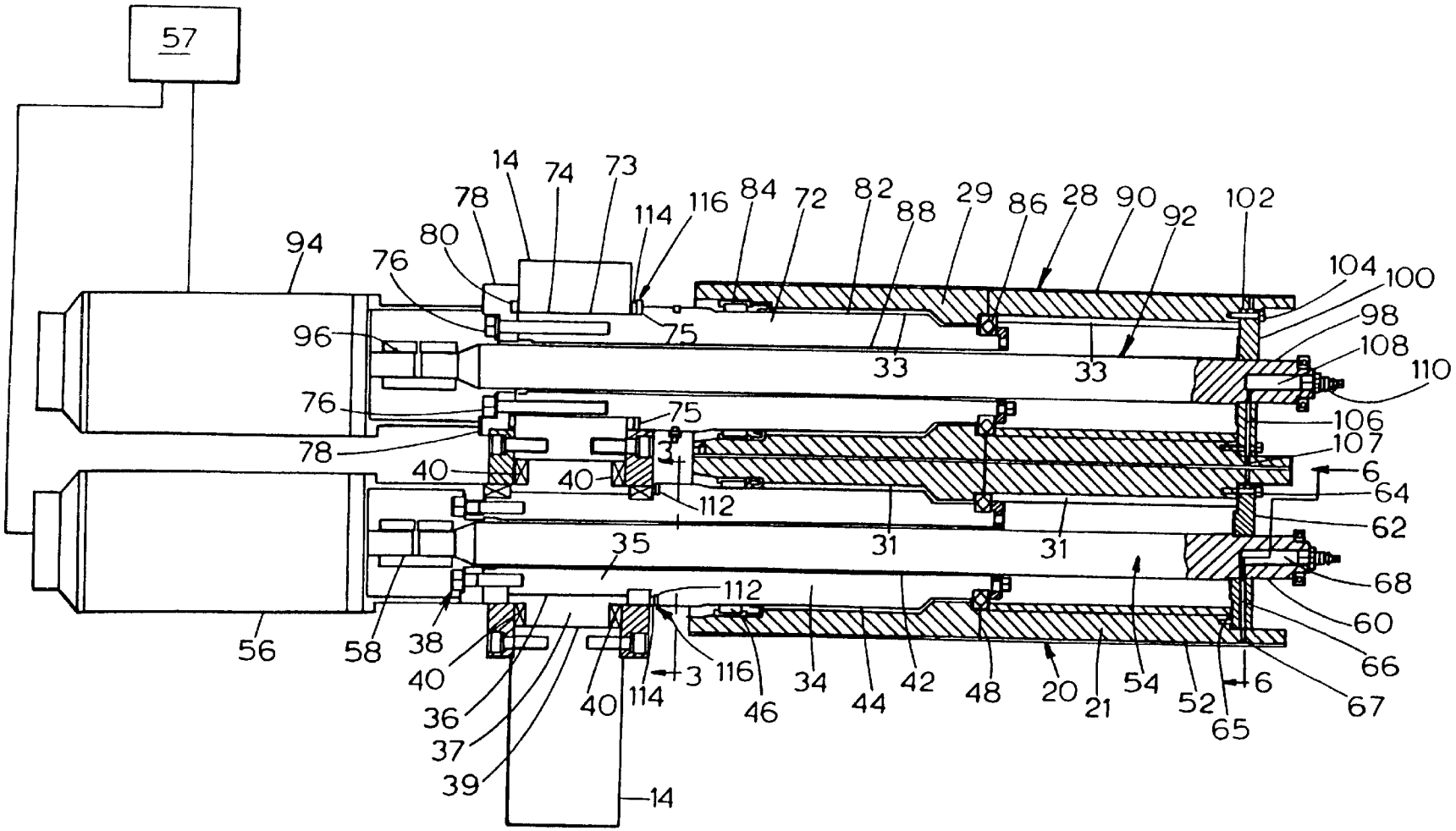
FIG. 2 enlarged cross-sectional view taken along lines 2—2 of FIG. 1 and showing a blanket cylinder and plate cylinder unit incorporating the cantilevered, self-driven features of the present invention.

Referring now to FIG. 2, blanket cylinder assembly 20 and plate cylinder assembly 28 are shown mounted in side-by-side cantilever fashion to side wall 14. It will be understood that the structure, function and operation of blanket cylinder assembly 18 and its adjacent plate cylinder assemblies 22, 24 is substantially the same as the structure, function and operation of cylinder assemblies 20 and 28 shown in FIG. 2. Similarly, the structure, function and operation of plate cylinder assembly 26 is substantially the same as plate cylinder assembly 28. Accordingly, only blanket cylinder assembly 20 and plate cylinder assembly 28 will be described in detail.

Blanket cylinder assembly 20 includes a support shaft 34 having a cylindrical base 35 which extends through a bore 36 in a carriage 37. Support shaft 34 also includes a shoulder 112 which abuts a pair of adjustment members 114, 116, which are used to alter the angle of support shaft 34 relative to side wall 14 as is explained in greater detail below. Support shaft 34 is rigidly secured to carriage 37 by a plurality of mounting bolts 38. Carriage 37 is slidably mounted in a slot 39 in side wall 14, and is supported for linear movement within slot 39 on a plurality of linear bearing sets 40. Carriage 37 thus permits the blanket cylinder assembly 20 to slide along a path perpendicular to the axis of support shaft 34. Support shaft 34 includes a generally cylindrical outer surface 44 and an inboard set of bearings 46 and an outboard set of bearings 48 which rotatably support the blanket cylinder 21. Support shaft 34 also includes a central longitudinal bore 42, the purpose of which is discussed in greater detail below. Blanket cylinder 21 includes an internal cavity 31, which is sized to fit over support shaft 34. A removable cylindrical blanket sleeve 52 fits over the outer surface of blanket cylinder 21 and is held in place by friction.

Figure 6:
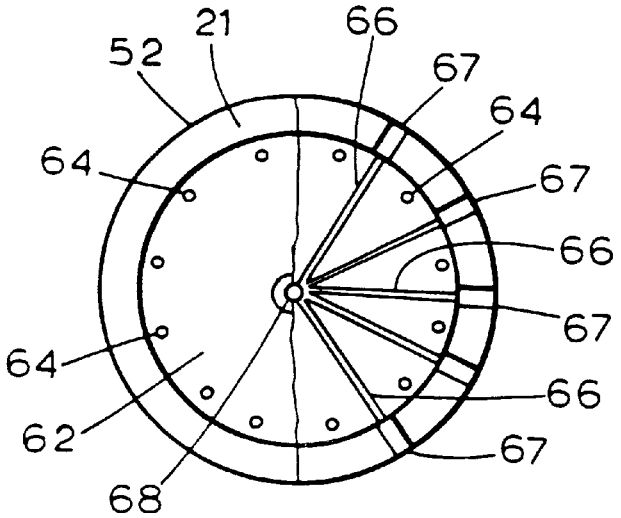
FIG. 6 is an enlarged end view, partly in section, of the end of the blanket cylinder shown in FIG. 2 (the end of the plate cylinder being identical) and illustrating the air passage in the drive shaft flange which communicates pressurized air to the exit ports on the cylinder outer surface to facilitate removal of the blanket sleeve.

A drive shaft 54 extends through bore 42 of support shaft 34 and is operatively connected to a drive motor 56 by a coupling 58. Drive motor 56 is preferably connected to a commercially available servo-controller 57, which permits the rotational orientation of the cylinder 21 to be controlled. Drive shaft 54 includes an outer end 60 having a circular mounting flange 62 which is mounted to an annular seat 65 on the inner surface of cylinder 21 by a plurality of mounting bolts 64 spaced circumferentially about the flange 62. As can be seen in FIGS. 2 and 6, flange 62 also includes a plurality of radially extending bores 66 which are aligned with a plurality of circumferentially spaced exit ports 67 through the outer surface of the blanket cylinder 21. Outer end 60 of drive shaft 54 also includes a bore 68 which intersects each of the plurality of radial bores 66. An air fitting 70 is affixed to the end 60 of drive shaft 54, which permits compressed air from a supply source (not shown) to be routed through ports 67 via bore 68 and radial bores 66, in order to permit the removal of sleeve 52 from blanket cylinder 21 in a manner commonly employed in the art. Moreover, because the blanket cylinder 21 is supported in true cantilever fashion, the sleeve 52 can be removed from blanket cylinder 21 without disconnecting bearing assemblies or providing temporary support since there is no interference from side wall 16 or from the drive system.

Referring now to the plate cylinder assembly 28, which is shown on the top when viewing FIG. 2, it includes a support shaft 72 having an eccentric base 73 which extends through a bore 74 in side wall 14. Support shaft 72 also includes a shoulder 75 which abuts a pair of adjustment members 114, 116, which are used to alter the angle of support shaft 72 relative to side wall 14 as is explained in greater detail below. Support shaft 72 is secured to side wall 14 by a plurality of mounting bolts 76, thrust washer 78, and thrust bearings 80. Thrust washer 78 and thrust bearings 80 permit the rotation of support shaft 72 about its eccentric base 73 using a throw off lever (not shown) in order to move plate cylinder assembly 28 towards or away from blanket cylinder assembly 20 during changeover, maintenance, or adjustments of press 10.

Support shaft 72 includes a generally cylindrical outer surface 82 and an inboard set of bearings 84 and an outboard set of bearings 86 which rotatably support the plate cylinder 29. Support shaft 72 also includes a central longitudinal bore 88. A removable cylindrical plate or impression sleeve 90 fits over the outer surface of plate cylinder 29 and is held in place by friction. Plate cylinder 29 includes an internal cavity 33, which is sized to fit over support shaft 72. A drive shaft 92 extends through bore 88 of support shaft 72 and is operatively connected to a drive motor 94 by a coupling 96. Drive motor 94 is also connected to servo-controller 57. Drive shaft 92 includes an outer end 98 having a circular mounting flange 100 which is mounted to an annular seat 102 on the inner surface of cylinder 29 by a plurality of mounting bolts 104 spaced circumferentially about the flange 100. Flange 100 also includes a plurality of radially extending bores 106 which are aligned with a plurality of circumferentially spaced exit ports 107 through the outer surface of plate cylinder 29. Outer end 98 of drive shaft 92 also includes a bore 108 which intersects each of the plurality of radial bores 106. An air fitting 110 is affixed to the end 98 of drive shaft 92, which permits compressed air from a supply source (not shown) to be routed through ports 107 via bore 108 and radial bores 106, in order to permit the removal of plate or impression sleeve 90 from cylinder 29 in a manner commonly employed in the art. As with the blanket cylinder 21, because the plate cylinder 29 is supported in true cantilever fashion, the removal of impression sleeve 90 can be accomplished without disconnecting bearing assemblies or providing temporary support since there is no interference from side wall 16 or the drive system.

Figure 3:
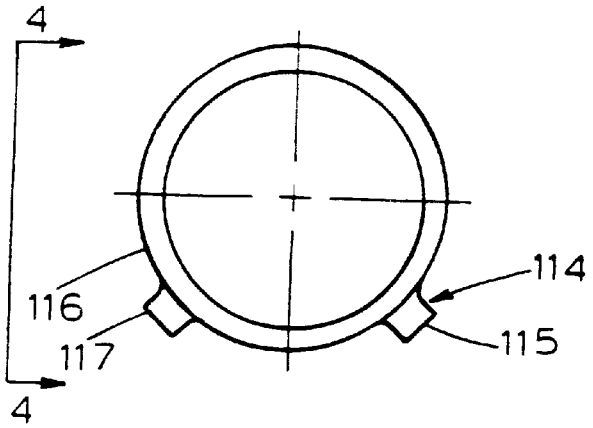
FIG. 3 is a fragmentary cross-sectional view taken substantially along lines 3—3 of FIG. 2.
Figure 4:
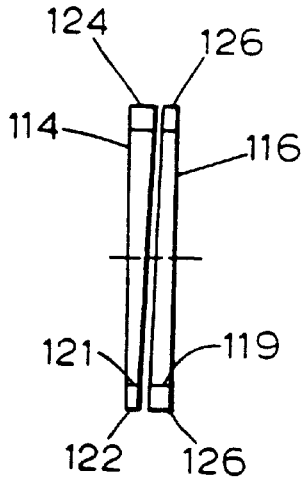
FIG. 4 is a side elevational view taken along lines 4—4 of FIG. 3 illustrating the tapered adjustment washers positioned for a zero bias angle.
Figure 5:
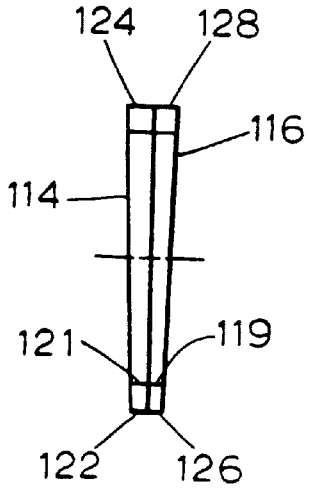
FIG. 5 is a side elevational view similar to FIG. 4 but illustrating the tapered washers adjusted for a maximum bias angle.

Referring now to FIGS. 3 through 5, adjustment members 114, 116 each include a tab or handle 115, 117 and a central bore 119, 121, respectively, which is sized to fit over the base 35 or 73 of their corresponding support shafts 34 or 72. As shown in FIGS. 4 and 5, adjustment member 114 includes a narrowed portion 122 and a thickened portion 124, while adjustment member 116 includes a narrowed portion 126 and a thickened portion 128. As can be seen in FIG. 2, a set of adjustment members 114, 116 is disposed about each of the bases 35 and 73 of shafts 34 and 72 in abutment with the shoulders 112, 75, respectively. Moreover, the adjustment members 114, 116 are wedged between the shoulders 112 and 75 of the support shafts 34 and 72 and the carriage 37 and side wall 14, respectively.

In operation, the support shaft 34 is mounted to carriage 37 with the adjustment members 114, 116 abutting the shoulder 112 adjacent the base 35. The members 114, 116 are rotated to the position shown in FIG. 4 to achieve a zero bias angle, or to the position shown in FIG. 5 to achieve a maximum bias angle. Alternatively, the adjustment members 114, 116 may be positioned in a plurality of intermediate positions. When the shaft 34 is secured to the carriage 37 using mounting bolts 38, the wedging action of the adjustment members 114, 116, when adjusted to achieve a desired bias angle, effectively bends the shaft 34 slightly. Thus, and by similarly using the adjustment members 114, 116 associated with the support shaft 72, the ends of the respective cylinder assemblies 20, 28 may be brought closer together or moved farther apart, in order to achieve a generally uniform contact pressure along the lengths of the cylinder assemblies 20 and 28.

The blanket cylinder 21 is mounted on stationary support shaft 34 on the bearing assemblies 46 and 48, and the drive shaft 54 is inserted through bore 42, with flange 62 being secured to the annular seat 65 by bolts 64. Drive motor 56 is mounted to carriage 37 in a conventional manner and operatively connected to drive shaft 54 via a coupling 58. Similarly, plate cylinder 29 is mounted on stationary support shaft 72 on the bearing assemblies 84 and 86, and the drive shaft 92 is inserted through bore 88, with flange 100 being secured to the annular seat 102 by bolts 104. Drive motor 94 is mounted to eccentric base 73 of shaft 72 in a conventional manner and is operatively connected to drive shaft 92 via a coupling 96. Finally, servo-controller 57 facilitates the proper registration of cylinder 21 relative to cylinder 29, and also ensures that the cylinders 21, 29 remain synchronized and spin at the same peripheral speed.

Figure 7:
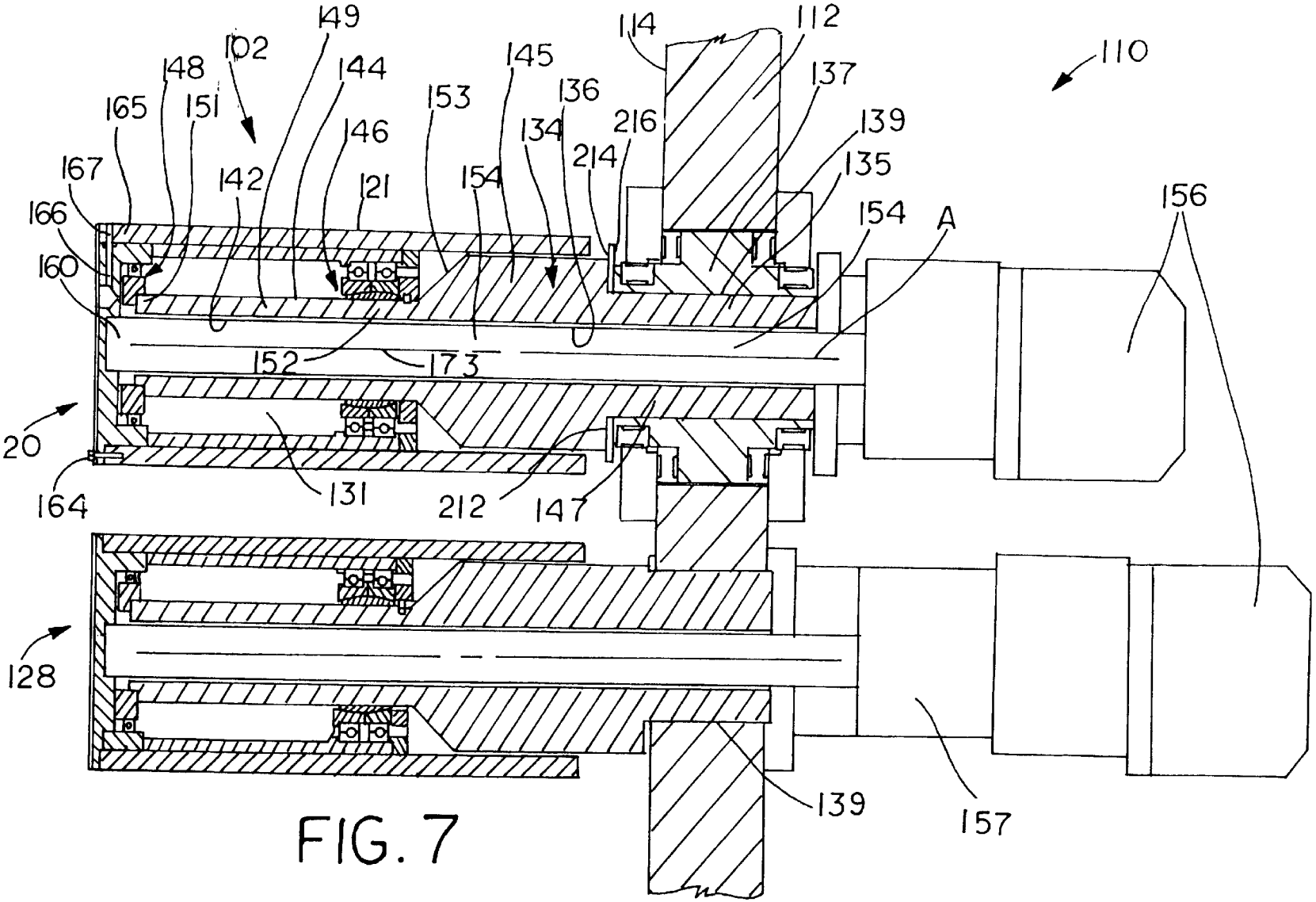
FIG. 7 is an enlarged cross-sectional view of a plate cylinder and blanket cylinder unit having a mounting arrangement constructed in accordance with the teachings of the present invention.

Referring now to FIGS. 7 through 12, a bearing support system assembled in accordance with the teachings of the present invention is generally referred to by the reference numeral 102, and is as shown in FIG. 7. The bearing support system 102 is adapted for use with a rotary offset printing press 110. The rotary offset printing press 110 may be the same or similar to the above described rotary offset printing press 10. To the extent practical, the same or similar elements described in the above embodiment will retain the same reference characters, with the reference characters for those elements being increased by 100.

It will be understood that the bearing support 102 may be used to support either a cylinder assembly 120 (which may be a blanket cylinder assembly), or a cylinder assembly 128 (which may be a plate cylinder assembly), on a frame 112. Preferably, each of the cylinder assemblies 120, 128 are mounted to the frame 112 in cantilever fashion as will be outlined in greater detail below. For the sake of brevity, only the structure and operation of the bearing assembly 102 installed on the cylinder assembly 120 will be described in detail. However, it will be understood that the bearing assembly 102 is equally adaptable for use on the cylinder assembly 128.

The cylinder assembly 120 includes a generally hollow rotatable cylinder 125 which defines an internal cavity 131 sized to fit over the support shaft 134 having a longitudinal axis or centerline designated by the reference arrow A. The cylinder 125 includes an outboard end 125*a*. The cylinder 125 is rotatably supported on the support shaft 134 by the bearing assembly 102. The cylinder 125 may include an inner carrier sleeve 123, and the cylinder 125 is sized to receive thereon a removable sleeve, a portion of which is viewable in FIG. 9 and designated as 125*b*, in a manner more fully described above with respect to the first embodiment. Alternatively, the cylinder 125 may be adapted to accept thereon a conventional plate sleeve.

The support shaft 134 includes a base 135 which extends through a bore 136 in a carriage 137. Alternatively, as shown with respect to the cylinder assembly 128 mounted on a similar support shaft 134, the base 135 may extend through a bore 139 in the frame 112 The support shaft 134 of cylinder assembly 120 preferably includes a shoulder 212 which abuts a pair of rotatable angular shims 214, 216, which shims may be used to alter the angle of the support shaft 134 relative to a sidewall 114 of the frame 112 in the manner discussed more fully with respect to the first embodiment described above. Note that the shims 214, 216 provide for the angular adjustment of the support shaft 134 relative to the frame 112. Further, the support shaft 134 may be secured to the carriage 137, and the carriage 137 may be slidable within the frame 112, all in a manner similar to that described above with respect to the first embodiment.

Figure 11:
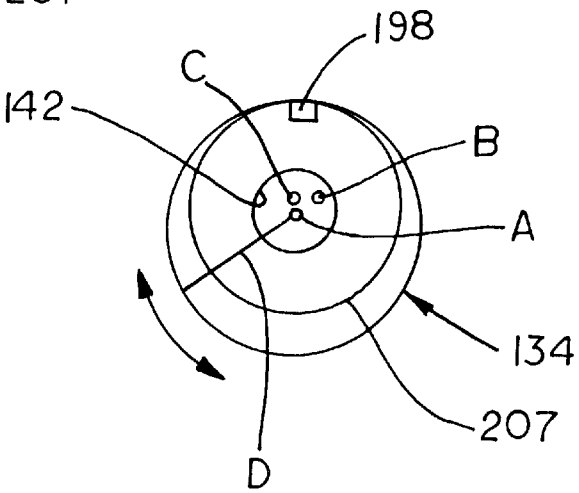
FIG. 11 is a elevational view taken along line 11—11 of FIG. 10 illustrating the eccentric shoulder at the outboard end of the support shaft.

Preferably, the base 135 is eccentric about a centerline generally designated by the reference arrow B, which is illustrated schematically in FIG. 11. It will be noted that the centerlines A and B are generally offset from each other. Accordingly, as would be known to those skilled in the art, rotation of the support shaft 134 about its base 135 (i.e., by rotating the base 135 within the frame 112), by virtue of the eccentric connection, would cause the centerline A to circumscribe an imaginary circle when the support shaft 134 is viewed from its end.

Referring again to FIGS. 7–10, the support shaft 134 includes a generally cylindrical outer surface 144, and will include a first, inboard section 145 having an end 147 fixed to the carriage 137 (and hence the frame 112), and a second, outboard section 149 having a free end 151. The inboard section 145 and the outboard section 149 are separated by a transition 153, which may be rounded so as to prevent stress risers. It will be understood that the inboard section 145 will have a first stiffness, while the outboard section 149 will have a second, lesser stiffness by virtue of having a smaller cross-sectional area as would be known to those of skill in the art. The support shaft 134 further includes a central portion 152, disposed generally outwardly of the transition 153 so as to lie generally on the inboard extent of the outboard section 149.

The bearing assembly 102 which rotatably supports the cylinder 125 on the support shaft 134 includes a first or inboard set of bearings 146 and an second or outboard set of bearings 148. The support shaft 134 also includes a central longitudinal bore 142, and a drive shaft 154 extends through the bore 142 of the support shaft 134 and is operatively connected to a drive motor 156, such as by a conventional shaft coupling (not shown). Preferably, at least one of the cylinder assemblies 120, 128 will be provided with a linear positioning mechanism 157. The linear positioning mechanism is preferably a linear ball screw actuator, which is commercially available from THK Corporation, although other actuators may also be employed, such as actuators available from the Actuator Division of Parker Corporation, Warner Electric, or Industrial Devices Corporation. The linear positioning mechanism 157 permits axial adjustment of the cylinder 125 relative to the support shaft 134 for purposes of sidelay registration, the importance of which is known to those of skill in the art. The drive motor 156 is preferably connected to a commercially available servo-controller (not shown), which permits the rotational orientation of the cylinder 125 to be controlled. The drive shaft 154 includes an outer end 160 having a circular mounting flange 162 which is mounted to an outer edge 165 of cylinder 125 by a plurality of mounting bolts 164 spaced circumferentially about the flange 162. Preferably, the mounting flange is secured to the drive shaft 154 by a lock nut 162*a*, and preferably the mounting flange 162 is keyed to the drive shaft 154 so as to rotate in common therewith. A plurality of bolts 219 are provided for securing the carrier sleeve 123 to the mounting flange 162.

The flange 162 may include a plurality of radially extending bores 166 which are aligned with a plurality of circumferentially spaced exit ports 167 which are spaced about the periphery of the cylinder 125 and which extend through the outer surface thereof. The bores 166 and the exit ports 167 will permit the installation and removal of an impression sleeve (not shown) using compressed air in the manner described in greater detail above with respect to the first embodiment.

Figure 8:
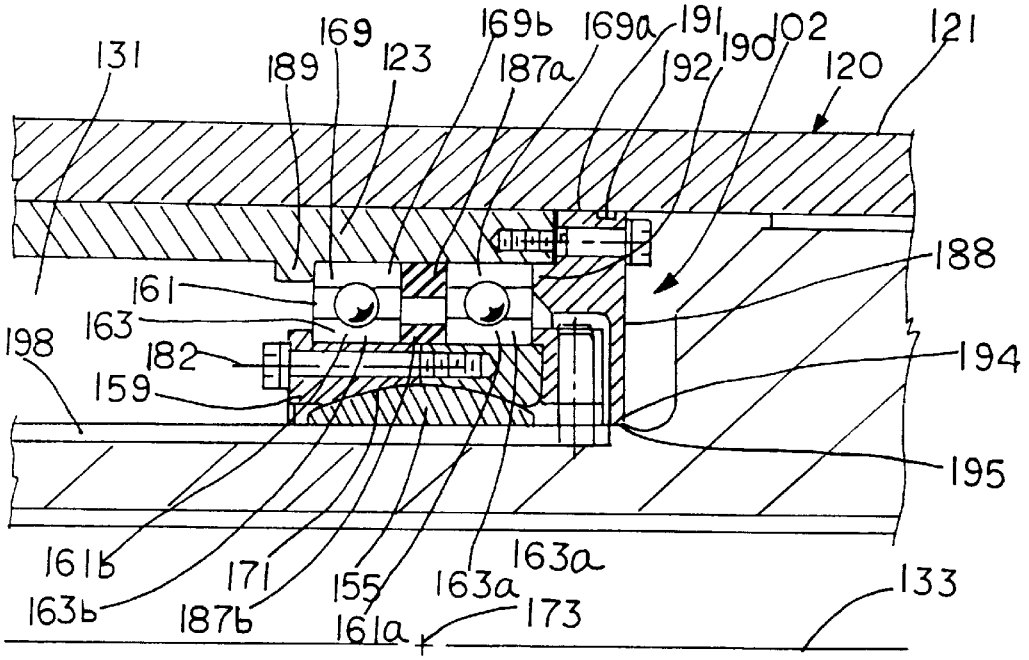
FIG. 8 is an enlarged fragmentary cross-sectional view of a central portion of the support shaft illustrating portions of the bearing assembly constructed in accordance with the teachings of the present invention.
Figure 8:
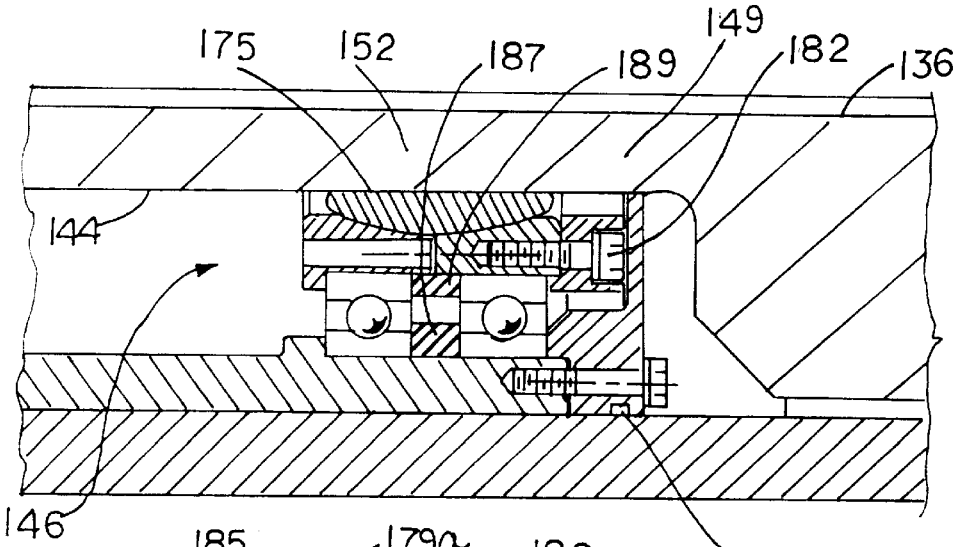

Referring now to FIG. 8, the inboard bearing set 146 is shown. The inboard bearing set 146 includes an inner race 155, a ring assembly 159, and an outer bearing 161 having a fixed race 163 and a moveable race 169. The inner race 155 is preferably a bronze ring having a convex and generally curved, spherical outer surface 171 which is curved about a theoretical center point 173. The inner race 155 also includes a bore 175 which is sized to fit onto the outboard section 149 such that the inner race will be free to slide longitudinally along the outboard section 149 of the support shaft 134.

Figure 8A:
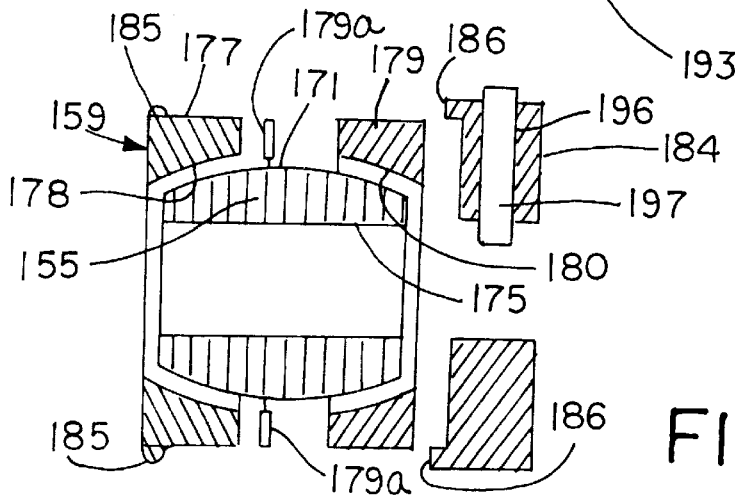
FIG. 8A is an enlarged fragmentary cross-sectional view of a portion of the ring assembly and the inner race.

As shown in FIG. 8A, the ring assembly 159 includes an outboard ring 177 and an inboard ring 179. Each ring 177, 179 includes a concave and generally curved inner surface 178, 180, respectively, which curved inner surfaces are curved to match the curvature of the outer surface 171 of the inner race 155. As shown in FIG. 8, the rings 177, 179 are attached to each other using a plurality of bolts 182, such that the ring assembly 159 generally surrounds or encompasses the inner race 155, so as to form a ball and socket arrangement. When so disposed, the ring assembly 159 will, as a unit, be pivotable or otherwise be permitted to swivel about the inner race 155 about the center point 173 of the inner race 155. An inboard retaining ring or member 184 is attached to the inboard side of the ring 179, such as by a plurality of mounting bolts. Preferably, one or more shims 179*a* may be provided between the rings 177, 179. The shims may be generally circular or any other suitable shape, and act to control the fit between the inner race 155 and the rings 177, 179. The shims control and/or limit the clamping force of the rings 177, 179 on the inner race 155, so that the ring assembly 159 will swivel properly about the inner race 155.

The outboard ring 177 includes an annular shoulder 185, and the retaining member 184 also includes an annular shoulder 186. The shoulders 185 and 186 cooperate to secure the inner race 163 of the outer bearing 161 to the ring assembly 159, such that the outer bearing 161 will swivel or pivot in conjunction with the ring assembly 159 about the center point 173.

Referring again to FIG. 8, the outer bearing 161 preferably includes an inboard bearing 161*a* and an outboard bearing 161*b*, each having fixed inner races 163*a*, 163*b*, respectively, and moveable outer races 169*a*, 169*b*, respectively. A pair of spacers 187*a* and 187*b* are disposed between the bearings 161*a*, 161*b*. Preferably, the spacers 187*a* and 187*b* are of unequal length, so that upon securing the bearings 161*a* and 161*b* in place as outlined below, any play in the bearings 161*a* and 161*b* will be removed.

A barrier ring 188 is secured to the inner surface of the cylinder 125, such as by securing the barrier ring 188 to the inner carrier sleeve 123, such as by using a plurality of mounting bolts. The barrier ring 188 includes a shoulder 189, while the inner carrier sleeve 123 includes a shoulder 190, which shoulders 189, 190 cooperate to secure the outer race 169 of the bearing 161. The barrier ring 188 includes an outer edge 191 sized to fit tightly against the inner surface of the cylinder 125, with the outer edge 191 having defined therein an annular groove 192. The annular groove 192 is sized to receive an O-ring seal 193 therein. The barrier ring 188 also includes an inner edge 194 sized to form a small gap 195 between the inner edge 194 and the adjacent outer surface of the support shaft 134. The inner edge 194 of the barrier ring 188 helps to maintain lubricant inside the cavity 131.

Preferably, a shim (not shown) is provided at the interface between the retaining member 184 and the inner carrier sleeve 123, such that the proper pressure is applied by the shoulders 189, 190 to the outer races 169*a* and 169*b*.

Similarly, a shim (not shown) is supplied at the interface between the retaining member 184 and the inboard ring 179, such that the proper pressure is applied by the shoulders 185, 186 to the inner races 163*a* and 163*b*.

Referring again to FIG. 8A, the retaining member 184 includes a radially disposed bore 196 having a pin 197 disposed therein. It will be noted that the outboard section 149 of the support shaft 134 includes a longitudinal slot 198 (viewable in FIGS. 8, 10 and 11), which slot 198 is sized to receive therein the pin 197. The pin 197 may be spring loaded.

Figure 9:
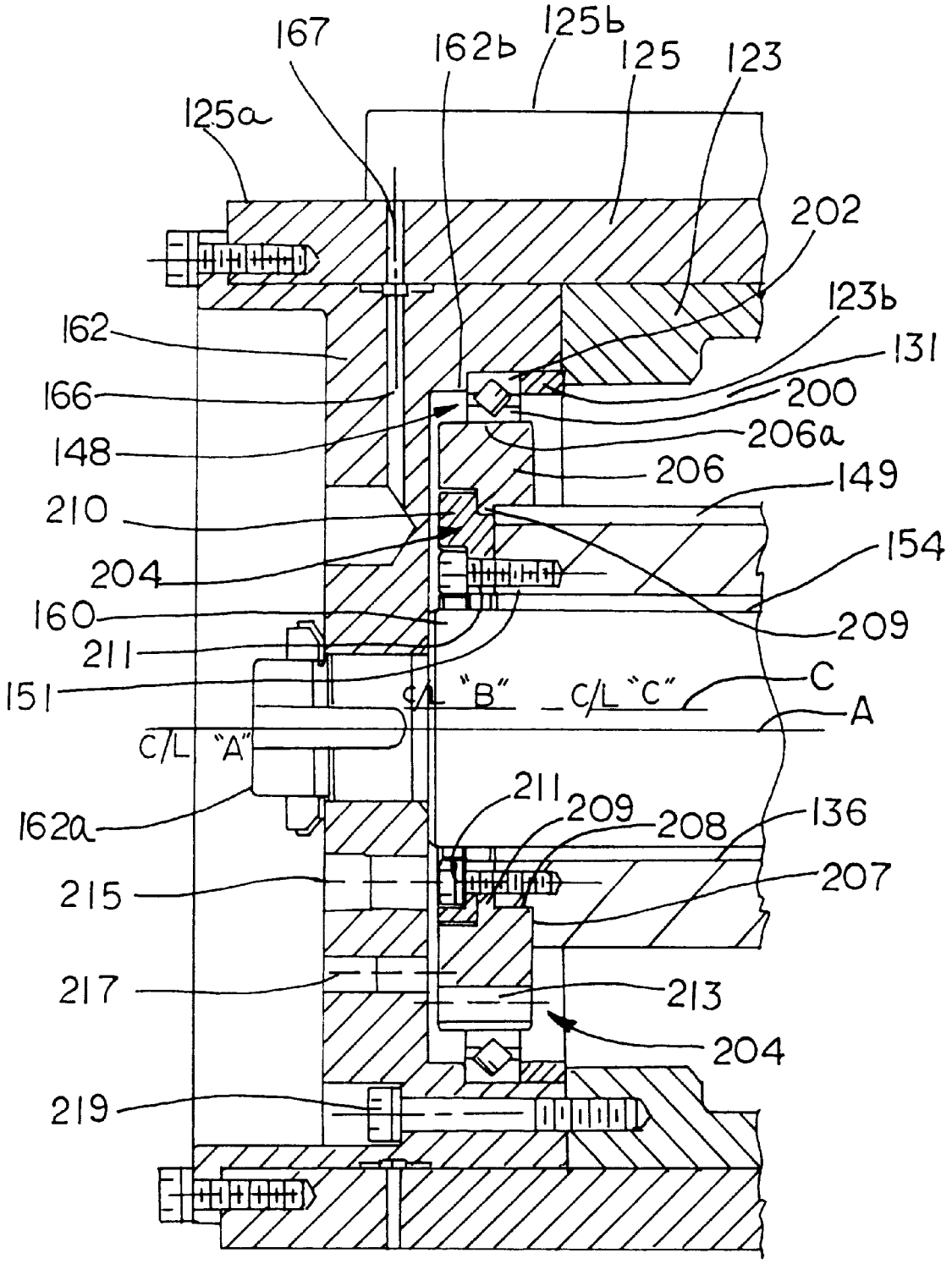
FIG. 9 is an enlarged fragmentary cross-sectional view of an outboard portion of the support shaft illustrating portions of the bearing assembly constructed in accordance with the teachings of the present invention.
Figure 10:
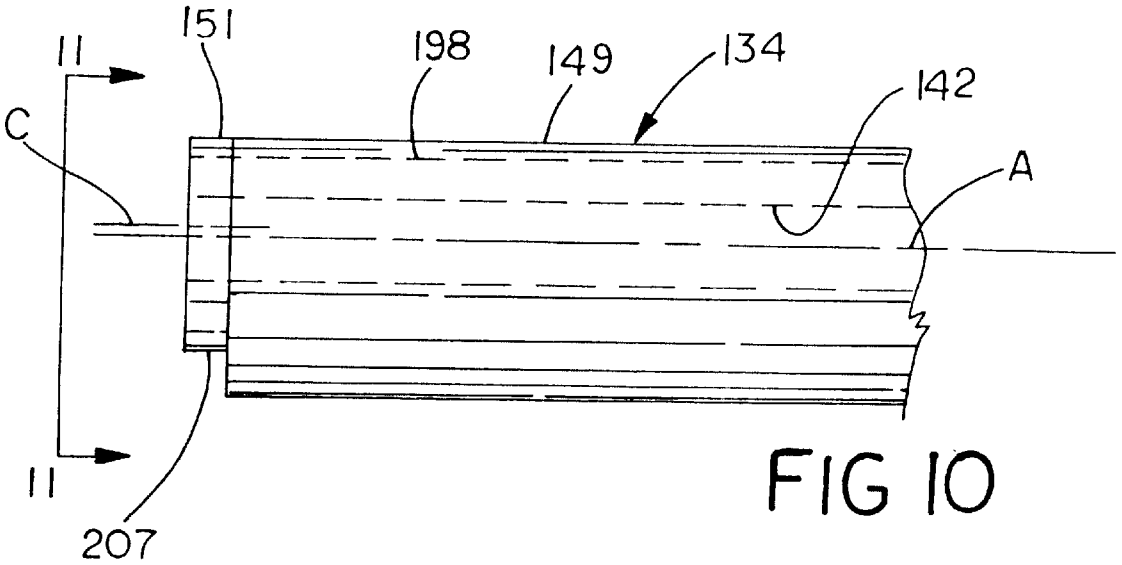
FIG. 10 is a fragmentary view of the outboard end of the support shaft illustrating the eccentric shoulder.

Referring now to FIG. 9, the outboard bearing set 148 is shown. The outboard bearing set 148 includes a fixed inner race 200 and a moveable outer race 202, which outer race 202 is preferably of split construction. Still preferably, the outboard bearing set 148 is preferably a cross roller bearing device, such as a split outer race Type RA cross roller bearing unit manufactured by THK Corporation.

An eccentric adjustment mechanism 204 is provided at the free end 151 of the support shaft 134. The adjustment mechanism 204 includes an eccentric adjustment ring 206 that is eccentrically and rotatably mounted to an eccentric mounting shoulder 207 formed in the free end 151 of the support shaft. The eccentric mounting shoulder 207 can be seen in FIGS. 9, 10 and 11. It will be noted that the eccentric mounting shoulder 207 is centered about a centerline generally designated by the reference arrow C, and it will be noted that the centerline C is offset from the centerline A. In the preferred embodiment in which the cylinder 125 is approximately thirty six (36) inches in length, the centerlines A and C will be offset approximately three (3) millimeters. FIG. 11 also illustrates the preferred eccentric relationship of centerlines A, B, and C, it being understood that the entire support shaft 134 may be rotated about the centerline B as outlined above.

As shown in FIG. 9, the fixed inner race 200 of the bearing set 148 is mounted to the circumferential outer surface 206*a* of the adjustment ring 206. Preferably, the inner race 200 is slidable relative to the outer surface 206*a* in response to longitudinal movement of the drive shaft 154 during sidelay adjustment. Still preferably, the inner race 200 may be keyed to the outer surface 206*a* of the adjustment ring 206 in order to prevent rotation of the inner race 200. The outer race 202 of the bearing set 148 is preferably secured by cooperating shoulders 162*b*, 123*b* on the mounting flange 162 and the carrier sleeve 123, respectively which shoulders also control the amount of play in the outer race 202.

The adjustment ring 206 also includes an inner shoulder 209, which is engaged by a retaining flange or ring 210 in order to clamp the adjustment ring 206 in place. The retaining ring 210 is secured to the free end 151 of the support shaft 134 by a plurality of bolts 211.

The adjustment ring 206 also includes one or more bores 213, while the mounting flange 162 includes one or more bores 217 which may be aligned with the bores 213. The bores 213 and 217 may be used to insert a lubricating tool into the cavity 131 in order to provide lubricant to the bearing sets 146 and 148. The oil level in the cavity 131 may be checked in a similar fashion. It will be noted that the mounting flange 162 also includes one or more bores 215, which may be aligned with the bolts 211 by rotating the cylinder 125 in order to provide access to the bolts 211. The bores 213 and 217 may also be used in order to adjust the position of the adjustment ring 206 as follows. Upon loosening the bolts 211 to release the clamping force on the adjustment ring 216, a tool (not shown) may be inserted into bores 213 and 217, such that by rotating the cylinder 125 (such as manually) the rotational position of the adjustment ring 216 will be changed. The bolts 211 can then be re-tightened when the adjustment ring 206 is in the desired position.

Figure 12:
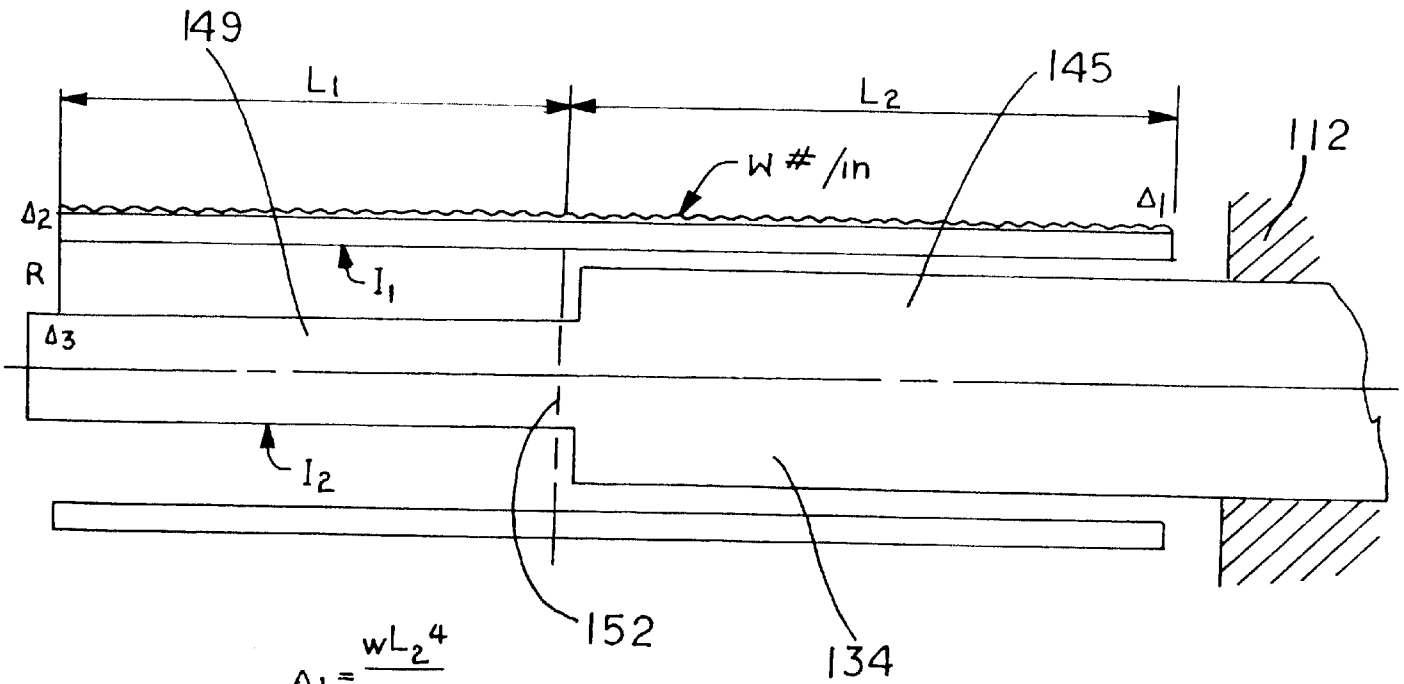
FIG. 12 is a schematic view of either the plate cylinder or blanket cylinder assembly illustrating the derivation of certain critical dimensions thereof.

Referring now to FIG. 12, it will be noted that the inboard bearing set, more specifically, the center of the inboard bearing set 146 (i.e., the center point 173) is preferably disposed a predetermined distance from the frame 112. The calculation of this predetermined distance will be explained below, wherein:

$L_1$, $L_2$=Length $\Delta_1$, $\Delta_2$, $\Delta_3$=Deflection (at locations indicated in FIG. 12)

$I_1$, $I_2$, $I_3$=Section Moment of Inertia

R=Load w=Uniformly distributed load

E=Modulus of Elasticity

With the remaining variables being known based upon a chosen support shaft having known dimensions, and for a known load, the desired ratio of $L_1$ to $L_2$ may be derived as follows, with reference being had to FIG. 12:

$$\Delta_1 = \frac{wL_2^4}{8EI_1}$$

$$\Delta_2 = \frac{I}{EI_1}\left(\frac{wL_1^4}{8} - \frac{RL_1^3}{3}\right)$$

$$\Delta_3 = \frac{RL_1^3}{3EI_2}$$

$$\text{FOR EVEN STRIPE } \Delta_1 = \Delta_2$$

$$\text{BUT } \Delta_2 = \Delta_3 \quad \therefore \quad \Delta_1 = \Delta_2 = \Delta_3$$

$$\text{SOLVING FOR } L_1 \text{ AND } L_2$$

$$\frac{L_1}{L_2} = \pm\sqrt{\frac{I_1 + I_2}{I_1}}$$

In operation, the support shaft 134 is mounted to the frame 112 in the manner similar to that described above with respect to the first embodiment. The inner carrier sleeve 123 and the inboard bearing set 146 may be pre-assembled, such that an installer may slide the carrier sleeve 123 and the inboard bearing set 146 onto the support shaft 134. With the cylinder 125 may be shifted toward the frame 112, the outboard bearing set 148 and the adjustment mechanism 204 can then be assembled, with the adjustment ring 206, the retaining ring 210, and the mounting flange 162 secured as outlined above. Once assembled, the cylinder 125 may be secured to the mounting flange 162.

Once assembled, the bearing assembly 102 permits angular adjustment of the cylinder 120 relative to the support shaft 134 (i.e., the cylinder 120 may pivot or swivel about an axis generally designated by the reference arrow D in FIG. 11, which axis D extends perpendicular relative to the longitudinal axis or centerline A of the support shaft 134. It will be understood that the axis D extends through the center point 173. Further, the axis D may rotate about the axis A as the adjustment ring 206 is adjusted as will be outlined below. For example, the axis D may extend out of the plane of FIGS. 7 and 8, although as would be known to one skilled in the art, the axis D may also be disposed parallel to the plane of FIGS. 7 and 8, or at some angle in between.

For example, when it is desired to adjust the angular position of the cylinder 125 relative to the support shaft 134, the adjustment mechanism 204 may be used as follows.

Upon loosening the bolts 211 in the manner described above, the adjustment ring 206 can be rotated using a tool inserted through the bores 213 and 217. The eccentric ring 206 turning on the eccentric shoulder 207 in the support shaft 134 causes the outer end 125*a* of the cylinder 125 to move. With the eccentric portion of the ring 206 disposed upwardly, the outboard end 125*a* of the cylinder 125 will be urged upwardly. With the eccentric portion of the ring 206 disposed downwardly, the outboard end 125 of the cylinder 125 will be urged downwardly. Location of the eccentric portion of the ring 206 to either side (i.e., out of the plane of FIGS. 7 or 8 in either direction) will urge the outboard end 125*a* of the cylinder 125 out of the plane of FIGS. 7 and 8 in a corresponding direction. When the desired angular position of the cylinder 125 relative to the support shaft 134 is reached, the bolts 211 are again tightened, which causes the retaining ring 210 to secure the adjustment ring 206 in place. By so doing, and by virtue of the swiveling or pivoting movement permitted by the ring assembly 159 mounted to the inner race 155, printing pressure along the length of the cylinder assemblies 120, 128 may be controlled and made substantially uniform.

Moreover, the pin-in-slot connection between the retaining member 184 and the support shaft 134 (item the pin 197 carried by the retaining member 184 which engages the longitudinal slot 198 in the support shaft 134) enables the entire inboard bearing set 146 to move longitudinally relative to the support shaft 134 in response to longitudinal adjustments produced by the linear positioning mechanism 157. As noted above, the bearing set 148 is longitudinally slidable relative to the ring 206 during sidelay adjustment.

It will be understood that the above description does not limit the invention to the above-given details. It is contemplated that various modifications and substitutions can be made without departing from the spirit and scope of the following claims.

What is claimed is:

1. A printing press, comprising:

a frame;

a support shaft, the support shaft having an inboard fixed end attached to the frame, a free end disposed outwardly away from the frame, and a central section connecting the fixed end to the free end, the support shaft defining a longitudinal axis;

a cylinder; and a bearing assembly for rotatably supporting the cylinder on the support shaft, the bearing assembly including an inboard bearing set secured to the support shaft adjacent the central portion and further including an outboard bearing set secured to the support shaft adjacent the free end, a portion of the bearing assembly being adapted to permit angular adjustment of the cylinder about an axis perpendicular to the support shaft longitudinal axis.

2. The device of claim 1, wherein the support shaft includes an inboard portion disposed adjacent the frame and having a first cross-section, and further includes an outboard portion having a second cross-section less than the first cross-section.

3. The device of claim 1, wherein the support shaft includes an inboard portion having a first stiffness and further includes an outboard portion having a second stiffness less than the first stiffness.

4. The device of claim 1, wherein the inboard bearing set includes an inner race mounted to the shaft, a ring assembly mounted to the inner race, and an outer bearing set surrounding the ring assembly, the outer bearing set having an inner race secured to the ring assembly and a moveable race secured to the cylinder.

5. The device of claim 4, wherein the inner race includes a convex outer surface, and wherein the ring assembly includes a concave inner surface sized to be received over the inner race convex outer surface.

6. The device of claim 4, wherein the ring assembly includes an inboard ring and an outboard ring, the inboard ring and the outboard ring being secured to each other and surrounding the inner race.

7. The device of claim 4, wherein the ring assembly surrounds and engages the inner race at a generally spherical interface, the ring assembly being adapted to swivel about a center point of the inner race.

8. The device of claim 6, including an inboard retaining member operatively connected to the inboard ring, and wherein the retaining member and the outboard ring include opposed, cooperating shoulder portions adapted to secure an inner race of the outer bearing set to the ring assembly.

9. The device of claim 1, wherein the bearing assembly is adapted for longitudinal movement relative to the support shaft.

10. The device of claim 4, wherein the inboard bearing set includes an inboard retaining member secured to the inboard ring, the retaining member being engaging the shaft to thereby prevent rotation of the ring assembly about the shaft.

11. The device of claim 10, wherein the support shaft includes a slot and wherein the retaining member includes a pin, the pin and the slot cooperating to permit longitudinal adjustment of the bearing assembly relative to the support shaft and further cooperating to prevent rotation of the ring assembly about the support shaft.

12. The device of claim 1, wherein the support shaft includes an inboard portion having a first cross-section and an outboard portion having a second cross-section less than the first cross-section.

13. The device of claim 12, wherein the support shaft includes a generally rounded transition portion between inboard portion and the outboard portion.

14. The device of claim 1, wherein the bearing assembly is disposed along the support shaft a predetermined distance from the support shaft fixed end.

15. The device of claim 1, wherein the support shaft includes an inboard portion having a first stiffness and further includes an outboard portion having a second stiffness less than the first stiffness, and further wherein the bearing assembly is disposed on the outboard portion a predetermined distance from the frame.

16. The device of claim 1, wherein the cylinder includes an inboard end and an outboard end and the support shaft includes an axial bore, and including a drive shaft extending though the axial bore and having an inboard end adapted to engage a drive motor and an outboard end adapted to engage the cylinder outboard end, and further wherein the bearing assembly and the drive shaft are adapted for axial movement relative to the support shaft.

17. The device of claim 1, wherein the bearing assembly and the support shaft are adapted to permit the cylinder to swivel about a predetermined location, and wherein the outboard bearing set includes an eccentric mechanism adapted to swivel the cylinder about the predetermined location.

18. The device of claim 1, wherein the bearing assembly and the support shaft are adapted to permit the cylinder to swivel about a predetermined location, and including an eccentric adjuster engaging the outer bearing set and the support shaft free end, the eccentric adjuster being adapted to permit swiveling adjustment of the cylinder about the predetermined location.

19. The device of claim 1, wherein the cylinder encloses an internal cavity, and wherein the cylinder cavity is adapted to house therein a quantity of lubricant.

20. The device of claim 19, including a lubricant barrier ring operatively connected to an inner surface of the cylinder, the barrier ring having a peripheral groove adapted to receive an O-ring, the barrier ring being positioned such that O-ring is disposed against the cylinder inner surface.

21. A printing press, comprising:

a frame;

a support shaft, the support shaft having an inboard portion having a fixed end attached to the frame, an outboard portion having a free end disposed outwardly away from the frame, and an interconnecting central portion, the onboard portion having a first cross section and the outboard portion having a second cross section less than the first cross section;

a cylinder sized for placement over the support shaft; and a bearing assembly for rotatably supporting the cylinder on the support shaft, the bearing assembly including an inboard bearing set secured to the support shaft outboard portion and defining a center point disposed along a centerline of the support shaft a predetermined distance from the fixed end, and further including an outboard bearing set secured to the support shaft adjacent the free end, the bearing assembly being adapted to permit pivotal movement of the cylinder about the center point.

22. The device of claim 21, wherein the inboard bearing set includes an inner race mounted to the shaft, a ring assembly mounted to the inner race, and an outer bearing set operatively connecting the ring assembly and the cylinder.

23. The device of claim 22, wherein the inner race is sized for placement on the support shaft outboard portion and includes a convex outer surface, and wherein the ring assembly includes a concave inner surface sized to be received over the inner race convex outer surface, thereby permitting pivotal movement of the ring assembly relative to the inner race about the center point.

24. The device of claim 22, wherein the ring assembly includes an inboard ring and an outboard ring, each of the rings having a concave inner surface, the rings being mounted with their inner surfaces in contact with the inner race.

25. The device of claim 22, wherein the inner race has a generally spherical outer face and the ring assembly includes an inboard ring and an outboard ring, the rings being mountable to each other so as to generally surround and engage the inner race spherical outer face.

26. The device of claim 25, wherein the inboard bearing set is adapted to permit longitudinal movement of the inboard bearing set relative to the support shaft.

27. The device of claim 25, including a retaining member mounted to the inboard ring, the retaining member and the outboard ring including opposed, cooperating shoulder portions adapted to secure a portion of the outer bearing set to the ring assembly.

28. The device of claim 27, wherein the retaining member is adapted to prevent rotation of the ring assembly relative the shaft.

29. The device of claim 28, wherein the support shaft includes a longitudinal slot and the retaining member includes a pin adapted to engage the slot, the pin and the slot cooperating to permit longitudinal adjustment of the inboard bearing set relative to the support shaft.

30. The device of claim 21, wherein the cylinder includes an inboard end and an outboard end and the support shaft includes an axial bore, and further including a drive shaft extending though the axial bore and having an inboard end adapted to engage a drive motor and an outboard end adapted to engage the cylinder outboard end, the bearing assembly and the drive shaft being adapted for axial movement relative to the support shaft.

31. The device of claim 21, wherein the outboard bearing set includes an eccentric mechanism adapted to swivel the cylinder about the center point.

32. The device of claim 21, wherein the cylinder encloses an internal cavity, and wherein the cylinder cavity is adapted to house therein a quantity of lubricant.

33. The device of claim 32, including a lubricant barrier ring operatively connected to an inner surface of the cylinder, the barrier ring having a peripheral groove adapted to receive an O-ring, the barrier ring being positioned such that O-ring is disposed against the cylinder inner surface.

34. For use on a printing press having a frame, a bearing assembly for mounting a cantilevered printing cylinder to the frame, comprising:

a support shaft having an inboard portion having a fixed end attached to the frame and an outboard portion having a free end disposed outwardly away from the frame, the inboard portion having a first predetermined stiffness and the outboard portion having a second predetermined stiffness;

a printing cylinder adapted to receive thereon an axially removable impression sleeve; and a bearing assembly for rotatably supporting the printing cylinder on the support shaft, the bearing assembly including an inboard bearing set secured to the support shaft outboard portion and defining a swivel point disposed along a centerline of the support shaft a predetermined distance from the fixed end, and further including an outboard bearing set secured to the support shaft adjacent the free end;

whereby the bearing assembly permits swiveling adjustment of the printing cylinder about the swivel point.

35. A printing press, comprising:

a frame;

a cantilevered support shaft mounted to the frame and having a fixed end, a free end, and a central portion, the cantilevered support shaft defining a longitudinal axis;

a cylinder; and a bearing assembly arranged to rotatably support the cylinder on the cantilevered support shaft, the bearing assembly including an adjustable race disposed adjacent the central portion of the cantilevered support shaft, the adjustable race permitting angular adjustment of the cylinder about an axis perpendicular to the longitudinal axis of the cantilevered support shaft.

36. For use on a printing press having a frame, a bearing assembly for mounting a cantilevered printing cylinder to the frame, comprising:

a cantilevered support shaft having a fixed end attached to the frame, a free end disposed outwardly away from the frame, and a central portion disposed between the fixed end and the free end;

a printing cylinder adapted to receive thereon an axially removable impression sleeve; and a bearing assembly for rotatably supporting the printing cylinder on the support shaft, the hearing assembly including a first bearing set mounted to the support shaft adjacent the central portion and a second bearing set mounted to the support shaft adjacent at least one of the free end or the fixed end, the first bearing set defining a swivel point disposed along a centerline of the support shaft, the first bearing set and the second bearing set cooperating to permit adjustment of the printing cylinder about the swivel point.

* * * * *

UNITED STATES PATENT AND TRADEMARK OFFICE

CERTIFICATE OF CORRECTION

PATENT NO. : 6,318,257 B1 
DATED : November 20, 2001
INVENTOR(S) : Niemiro et al.

It is certified that error appears in the above-identified patent and that said Letters Patent is hereby corrected as shown below:

Column 16,
Line 4, delete "extending though" and insert -- extending through --.

Signed and Sealed this

Seventeenth Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,318,257 B1 
DATED : November 20, 2001
INVENTOR(S) : Niemiro et al.

It is certified that error appears in the above-identified patent and that said Letters Patent is hereby corrected as shown below:

Drawings,
Sheet 1, FIG. 1, a reference numeral and lead line for the plate cylinder 27 should be added, with the lead line extending to the plate cylinder 27 mounted on the plate cylinder assembly 26, as shown in FIG. 1 of the informal drawings.
Sheet 2, FIG. 2, a reference numeral and lead line for the air fitting 70 should be added with the lead line extending to the air fitting 70 attached to the end 60 of the drive shaft 54.
Sheet 4, FIG. 7, please delete reference numeral "165" and replace it with reference numeral -- 125 --.
Sheet 8, FIG. 12, please delete the formula reading: "$\frac{L_1}{L_2} - \sqrt[4]{\frac{l_1+l_2}{l_1}}$"

and replace it with the following formula, such that it matches the correct formula as originally shown in FIG. 12 of the informal drawings: -- $\frac{L_1}{L_2} = \sqrt[4]{\frac{l_1+l_2}{l_1}}$ --

Column 2,
Line 36, please delete "difficulty m maintaining" and insert -- difficulty in maintaining. --

Column 11,
Line 67, please delete "adjustment ring 216" and insert -- adjustment ring 206 --.

UNITED STATES PATENT AND TRADEMARK OFFICE

CERTIFICATE OF CORRECTION

PATENT NO. : 6,318,257 B1 
DATED : November 20, 2001
INVENTOR(S) : Niemiro et al.

It is certified that error appears in the above-identified patent and that said Letters Patent is hereby corrected as shown below:

Column 12,
Lines 35-40, please delete the formula: "$\frac{L_1}{L_2} = \pm\sqrt{\frac{I_1 + I_2}{I_1}}$"

and replace it with the following, such that it matches the correct formula as originally shown in FIG. 12 of the informal drawings:

-- $\frac{L_1}{L_2} = \sqrt[4]{\frac{I_1+I_2}{I_1}}$ --

Signed and Sealed this

Eighth Day of April, 2003

JAMES E. ROGAN
*Director of the United States Patent and Trademark Office*